US010184228B2

(12) United States Patent
Ito et al.

(10) Patent No.: US 10,184,228 B2
(45) Date of Patent: Jan. 22, 2019

(54) HYDRAULIC DRIVING DEVICE OF WORK MACHINE

(71) Applicant: Hitachi Construction Machinery Co., Ltd., Taito-ku, Tokyo (JP)

(72) Inventors: Masamichi Ito, Ushiku (JP); Takatoshi Ooki, Kasumigaura (JP); Kiwamu Takahashi, Moriyama (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 142 days.

(21) Appl. No.: 15/447,836

(22) Filed: Mar. 2, 2017

(65) Prior Publication Data

US 2018/0087243 A1 Mar. 29, 2018

(30) Foreign Application Priority Data

Sep. 29, 2016 (JP) ..... 2016-192107

(51) Int. Cl.
*F15B 21/14* (2006.01)
*E02F 9/22* (2006.01)
(Continued)

(52) U.S. Cl.
CPC ..... *E02F 9/2225* (2013.01); *E02F 9/22* (2013.01); *E02F 9/2217* (2013.01);
(Continued)

(58) Field of Classification Search
CPC .. F15B 2211/40561; F15B 2211/40569; F15B 2211/88; F15B 21/14; F15B 1/027; F15B 13/026; E02F 9/2217; E02F 9/2225
See application file for complete search history.

(56) References Cited

U.S. PATENT DOCUMENTS 5,787,963 A * 8/1998 Tsuji ..... B22D 27/11 164/120
9,702,118 B2 * 7/2017 Gorman ..... F15B 21/14
9,945,396 B2 * 4/2018 Shang ..... F15B 11/024

FOREIGN PATENT DOCUMENTS

EP 3 159 456 A1 4/2017
JP 2007-170485 A 7/2007
(Continued)

OTHER PUBLICATIONS

Extended European Search Report issued in counterpart European Application No. 17159127.4 dated Sep. 27, 2017 (Eight (8) pages).
(Continued)

*Primary Examiner* — F. Daniel Lopez
*Assistant Examiner* — Michael Quandt
(74) *Attorney, Agent, or Firm* — Crowell & Moring LLP

(57) ABSTRACT

To keep operability of a hydraulic actuator excellent even in a state pressure has been sufficiently accumulated in a pressure accumulator. In a hydraulic driving device of a work machine including a hydraulic actuator, a tank, a flow control valve, and a pressure accumulator, there are further provided with a first pressure compensation valve that is for controlling difference between front and back pressures of the flow control valve constant and a second pressure compensation valve that is arranged between the pressure accumulator and the tank and is for controlling difference between front and back pressures of the flow control valve and the first pressure compensation valve constant.

5 Claims, 12 Drawing Sheets

(51) Int. Cl.

| | |
|---|---|
| ***F15B 1/04*** | (2006.01) |
| ***F15B 11/08*** | (2006.01) |
| ***F15B 13/02*** | (2006.01) |
| ***F15B 13/04*** | (2006.01) |
| ***F15B 11/024*** | (2006.01) |
| *E02F 3/32* | (2006.01) |

(52) U.S. Cl.

CPC ..... *E02F 9/2232* (2013.01); *E02F 9/2267* (2013.01); *E02F 9/2271* (2013.01); *E02F 9/2285* (2013.01); *E02F 9/2296* (2013.01); *F15B 1/04* (2013.01); *F15B 11/024* (2013.01); *F15B 11/08* (2013.01); *F15B 13/026* (2013.01); *F15B 13/0401* (2013.01); *F15B 21/14* (2013.01); *E02F 3/32* (2013.01); *F15B 2211/40561* (2013.01); *F15B 2211/40569* (2013.01); *F15B 2211/465* (2013.01); *F15B 2211/57* (2013.01); *F15B 2211/88* (2013.01)

(56) References Cited

FOREIGN PATENT DOCUMENTS

| | | | |
|---|---|---|---|
| JP | 2009-250361 | A | 10/2009 |
| JP | 2009-275770 | A | 11/2009 |
| WO | WO 2016/083340 | A1 | 6/2016 |

OTHER PUBLICATIONS

English translation of document B1 (Japanese-language patent publication No. JP 2007-170485 A) previously submitted on Mar. 2, 2017 (Eighteen (18) pages).

* cited by examiner

HYDRAULIC DRIVING DEVICE OF WORK MACHINE

BACKGROUND

1. Field of the Invention

The present invention relates to a hydraulic driving device of a work machine capable of recovering energy from a hydraulic actuator to an accumulator and regenerating the same.

2. Description of the Related Art

As a prior art of the present technical field, an energy recovering/regenerating device is known in which, in recovering the potential energy of a front working mechanism of a work machine represented by a hydraulic excavator and the like, oil chambers on the bottom side and the rod side of a boom cylinder (hydraulic actuator) are made communicate with each other, hydraulic oil flowing out from the bottom side of the boom cylinder is regenerated to the rod side, and thereby energy is accumulated in the accumulator (pressure accumulator) while increasing the bottom pressure of the boom cylinder (Japanese Unexamined Patent Application Publication No. 2007-170485, and Japanese Unexamined Patent Application Publication No. 2009-275770, for example).

According to Japanese Unexamined Patent Application Publication No. 2007-170485, a pressure compensation valve for recovery and a recovery flow control valve are provided on a route that continues to an accumulator from the bottom side of a boom cylinder. The pressure compensation valve for recovery controls the difference between front and back pressures of the recovery flow control valve so as to be kept constant. When the difference between front and back pressures of the recovery flow control valve is small, the opening of the pressure compensation valve for recovery that is located on the upstream side of the recovery flow control valve becomes large, whereas when the difference between front and back pressures of the recovery flow control valve is large, the opening of the pressure compensation valve for recovery becomes small.

Thus, according to Japanese Unexamined Patent Application Publication No. 2007-170485, since the pressure compensation valve for recovery keeps the difference between front and back pressures of the recovery flow control valve constant, the flow rate of the flow passing through the recovery flow control valve can be controlled to a target flow rate matching the opening area of the recovery flow control valve. In other words, the contracting speed of the boom cylinder is controlled to a target speed.

Moreover, according to Japanese Unexamined Patent Application Publication No. 2009-275770, a regeneration control valve is provided on a route of regeneration from the bottom side of the boom cylinder to the rod side. According to Japanese Unexamined Patent Application Publication No. 2009-275770, the accumulation priority control can be executed in which a regeneration control valve is opened to accelerate a boom cylinder to a target speed quickly, the regeneration control valve is throttled after the boom cylinder reaches the target speed, and thereby the bottom pressure of the boom cylinder is increased and is accumulated in an accumulator.

In Japanese Unexamined Patent Application Publication No. 2007-170485, when pressure is sufficiently accumulated in the accumulator and the cylinder load is small (for example, when the boom lowers by own weight), the downstream pressure of the recovery flow control valve is large, but the upstream pressure of the recovery flow control valve becomes small, and therefore the difference between front and back pressures of the recovery flow control valve becomes small. Therefore, in order to keep the difference between front and back pressures of the recovery flow control valve at a predetermined pressure, the opening of the pressure compensation valve for recovery becomes large.

However, since the downstream pressure of the recovery flow control valve is determined by the pressure of the accumulator, even when the opening of the pressure compensation valve for recovery becomes the maximum, the difference between front and back pressures of the recovery flow control valve cannot be kept at a predetermined pressure, and the target flow rate cannot be secured for the recovery flow control valve. Therefore, there is a problem that the contracting speed of the boom cylinder drops and the operability deteriorates.

Further, in Japanese Unexamined Patent Application Publication No. 2009-275770 also, when the pressure is sufficiently accumulated in the accumulator in the accumulation priority control, similarly to Japanese Unexamined Patent Application Publication No. 2007-170485, such problem remains that the contracting speed of the boom cylinder drops and the operability deteriorates when the cylinder load is small.

The present invention has been achieved to solve the problems described above, and its object is to provide a hydraulic driving device of a work machine capable of keeping the operability of a hydraulic actuator excellent even in a state pressure is accumulated sufficiently in a pressure accumulator.

SUMMARY

In order to achieve the object described above, a representative aspect of the present invention is a hydraulic driving device of a work machine including: a hydraulic actuator that is operated by hydraulic oil supplied; a tank that stores return oil from the hydraulic actuator; a flow control valve for making hydraulic oil discharged from the hydraulic actuator flow toward the tank; and a pressure accumulator that accumulates pressure of the hydraulic oil that flows from the flow control valve toward the tank, in which there are provided: a first pressure compensation valve that is arranged between the hydraulic actuator and the pressure accumulator and is for controlling difference between front and back pressures of the flow control valve constant; and a second pressure compensation valve that is arranged between the pressure accumulator and the tank and is for controlling difference between front and back pressures of the flow control valve and the first pressure compensation valve constant.

According to one aspect of the present invention, even in a state pressure of the pressure accumulator is sufficiently accumulated, the difference between front and back pressures of the flow control valve can be kept constant, the actuator speed can be kept at a speed proportional to the opening area of the meter-out throttle of the flow control valve, and the operability of the hydraulic actuator can be kept excellent. In addition, problems, configurations and effects other than the above will be clarified by explanation of embodiments below.

DETAILED DESCRIPTION

Figure 1:
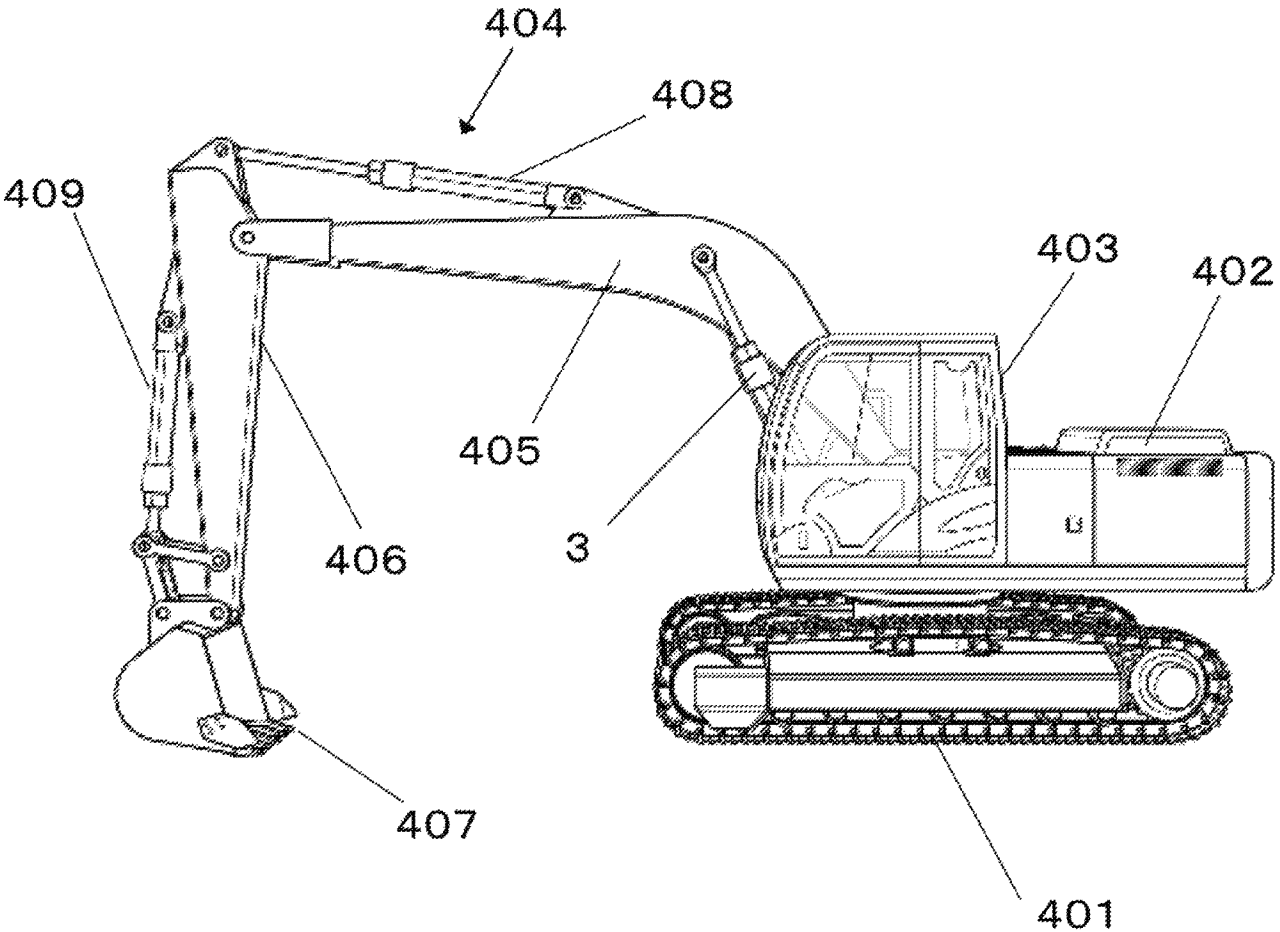
FIG. 1 is a side view of a hydraulic excavator to which the present invention is applied.

Below, embodiments of the present invention will be explained using the drawings. FIG. 1 is a side view of a hydraulic excavator to which a hydraulic driving device of a work machine related to the present invention is applied. As shown in FIG. 1, a hydraulic excavator that is a representative example of a work machine includes a travel base 401, a upper structure 402 that is swingably arranged on the travel base 401, a cab 403 that is arranged in the front part of the upper structure 402, and a front working mechanism 404 that is connected to the upper structure 402 in a manner movable upward and downward.

The front working mechanism 404 includes a boom 405 that is connected to the upper structure 402, a boom cylinder 3 that drives the boom 405, an arm 406 that is connected to the distal end of the boom 405, an arm cylinder 408 that drives the arm 406, a bucket 407 that is connected to the distal end of the arm 406, and a bucket cylinder 409 that drives the bucket 407. Further, all of the boom cylinder 3, the arm cylinder 408, and the bucket cylinder 409 are hydraulic actuators operated by hydraulic oil supplied from a main pump 101 (refer to FIG. 2).

First Embodiment

Figure 2:
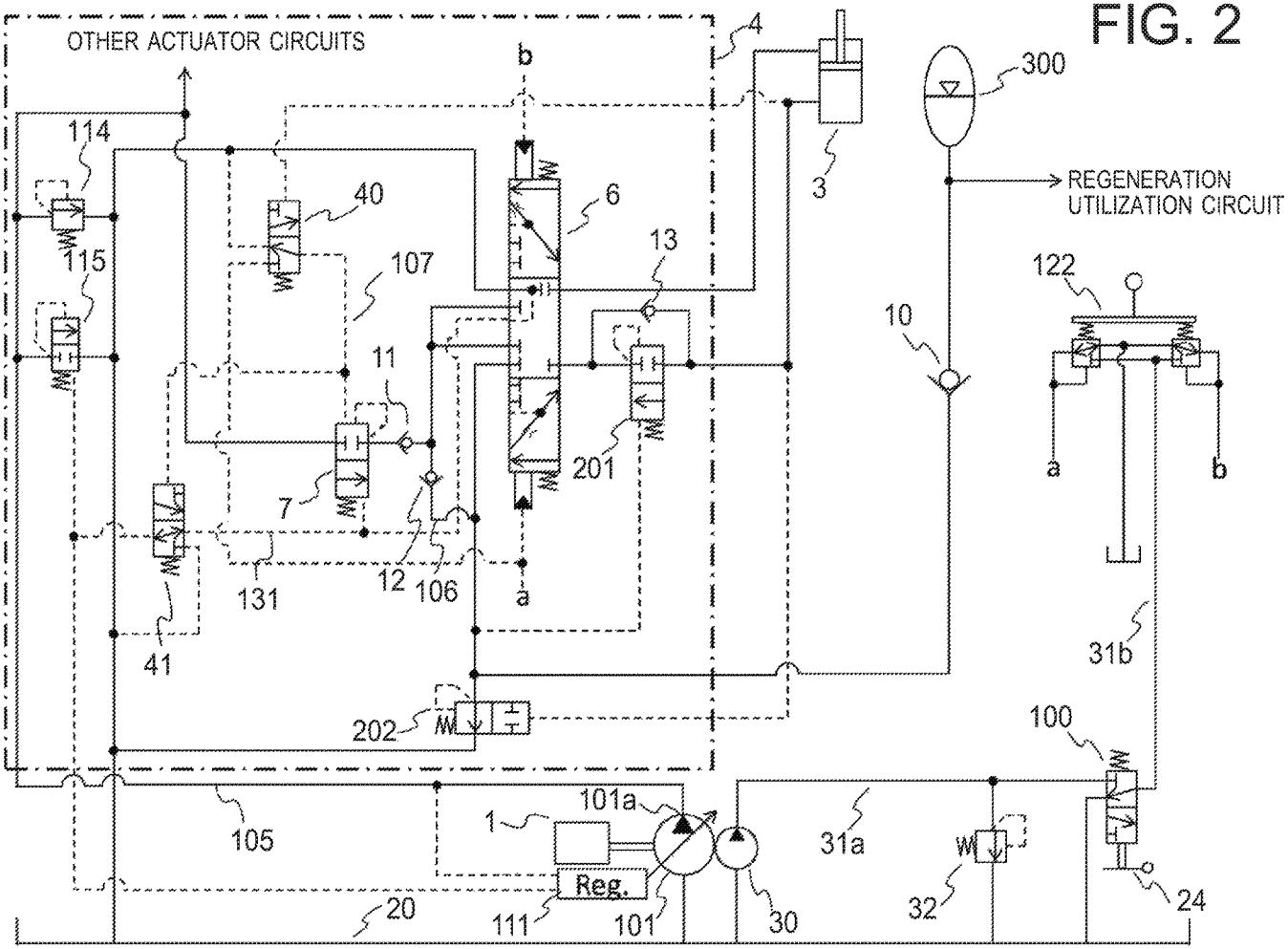
FIG. 2 is a block diagram of a hydraulic driving device of a work machine related to a first embodiment of the present invention.

Next, the hydraulic driving device of the work machine related to a first embodiment of the present invention will be explained. FIG. 2 is a block diagram of the hydraulic driving device of the work machine related to the first embodiment. The hydraulic driving device of the work machine (will be hereinafter referred to as "hydraulic driving device") related to the first embodiment includes a prime mover (an engine, for example) 1, the main pump (hydraulic pump) 101 of a variable displacement type including a discharge port 101*a* that is driven by the prime mover 1 and discharges hydraulic oil to a hydraulic oil supply path 105, a pump (pilot pump) 30 of a fixed displacement type, a regulator 111 for controlling the discharge flow rate of the main pump 101, the boom cylinder 3 that is driven by the hydraulic oil discharged from the main pump 101, and a control valve unit 4 that controls the flow rate of the hydraulic oil supplied from the main pump 101 to the boom cylinder 3.

The control valve unit 4 includes a flow control valve 6, a pressure compensation valve 7, a check valve 11, a main relief valve 114, and an unload valve 115, the flow control valve 6 being connected to the hydraulic oil supply path 105 and controlling the flow rate of the hydraulic oil and the flow direction of the hydraulic oil, the hydraulic oil being supplied from the main pump 101 to the boom cylinder 3, the pressure compensation valve 7 controlling the difference between front and back pressures of the flow control valve 6 so that the difference between front and back pressures of the flow control valve 6 becomes equal to a target differential pressure that is determined by a spring, the check valve 11 preventing reverse flow of the hydraulic oil of the boom cylinder 3 to the hydraulic oil supply path 105, the main relief valve 114 being connected to the hydraulic oil supply path 105 and controlling the pressure of the hydraulic oil supply path 105 so as not to become equal to or higher than a set pressure, the unload valve 115 becoming an open state and returning the hydraulic oil of the hydraulic oil supply path 105 to a tank 20 when the pressure of the hydraulic oil supply path 105 becomes higher than a pressure that is obtained by adding the set pressure of the spring to the maximum load pressure of plural hydraulic actuators driven by the hydraulic oil discharged from the discharge port 101*a* (unload valve set pressure).

The control valve unit 4 includes a load detection circuit 131 that is connected to the load port of the flow control valve 6 connected to the hydraulic oil supply path 105 and detects the load pressure (pressure) P1 of the boom cylinder 3. To the unload valve 115 described above, the load pressure P1 detected by the load detection circuit 131 is introduced. The control valve unit 4 includes a regeneration oil path 106 and a check valve 12, the hydraulic oil discharged from the cylinder bottom side of the boom cylinder 3 being connected to downstream of the check valve 11 through the flow control valve 6, the check valve 12 being arranged on the regeneration oil path 106, allowing the discharged oil from the cylinder bottom side of the boom cylinder 3 to flow downstream of the check valve 11, and preventing the reverse flow of the discharged oil.

The control valve unit 4 further includes a changeover valve 40 and a changeover valve 41. The changeover valve 40 is switched according to the cylinder bottom pressure of the boom cylinder 3. When the cylinder bottom pressure of the boom cylinder 3 is higher than a set threshold value, the changeover valve 40 introduces a boom lowering command pressure a to the pressure compensation valve 7 through a signal oil path 107, and makes the boom lowering pressure a act so as to close the opening of the pressure compensation valve 7. Thus, the hydraulic oil of the hydraulic oil supply path 105 is prevented from flowing in to the boom cylinder 3. In contrast, when the cylinder bottom pressure of the boom cylinder 3 is lower than the set threshold value, the changeover valve 40 is switched so as to discharge the hydraulic oil of the signal oil path 107 to the tank 20.

The changeover valve 41 is arranged on the load detection circuit 131, is configured to introduce the load pressure of the boom cylinder 3 to the unload valve 115 and the regulator 111 when the pressure of the signal oil path 107 is lower than a set threshold value, and is configured to introduce the tank pressure to the unload valve 115 and the regulator 111 when the pressure of the signal oil path 107 is higher than the threshold value.

Here, the boom cylinder 3 is connected to the discharge port 101*a* of the main pump 101 through the flow control valve 6, the pressure compensation valve 7 and the check valve 11, and the hydraulic oil supply path 105.

The control valve unit 4 further includes a first pressure compensation valve 201, a check valve 13, and a second pressure compensation valve 202, the first pressure compensation valve 201 being arranged between a cylinder bottom side oil chamber of the boom cylinder 3 and the flow control valve 6 (the upstream side of the flow of the cylinder bottom discharge oil with respect to the flow control valve 6) and controlling the difference between front and back pressures of the flow control valve 6 so as to become a target differential pressure Pref when the hydraulic oil flows from the cylinder bottom side oil chamber of the boom cylinder 3 to the direction of the flow control valve 6, the check valve 13 being arranged at a position parallel to the first pressure compensation valve 201, allowing the flow from the flow control valve 6 toward the cylinder bottom side oil chamber of the boom cylinder 3, and preventing the reverse flow of the hydraulic oil, the second pressure compensation valve 202 being arranged between an accumulator 300 and the tank 20 and controlling the differential pressure between the upstream pressure of the first pressure compensation valve 201 and the downstream pressure of the flow control valve 6 (the difference between front and back pressures of the first pressure compensation valve 201 and the flow control valve 6) so as to become the target differential pressure Pref.

The main pump 101 includes the regulator 111 to which the pressure (load pressure) P1 of the load detection circuit 131 and a discharge pressure Pp of the main pump 101 are introduced and which is operated by flow rate control or so-called load sensing control and power control, difference P1*s* between Pp and P1 and the target differential pressure Pref being compared to each other, tilting (capacity) of the main pump 101 being reduced in the case of P1*s*>Pref, and tilting (capacity) of the main pump 101 being increased in the case of P1*s*<Pref in the flow rate control, tilting (capacity) of the main pump 101 being reduced by increasing the discharge pressure Pp of the main pump 101 in the power control.

Moreover, the hydraulic driving device in the present embodiment includes the pump 30, a pilot relief valve 32, a gate lock valve 100, and an operation device 122, the pump 30 being of a fixed displacement type driven by the prime mover 1, the pilot relief valve 32 being connected to a pilot hydraulic oil supply path 31*a* of the pump 30 and generating a constant pilot pressure in the pilot hydraulic oil supply path 31*a*, the gate lock valve 100 being connected to the pilot hydraulic oil supply path 31*a* and switching whether a pilot hydraulic oil supply path 31*b* on the downstream side is connected to the pilot hydraulic oil supply path 31*a* or is connected to the tank 20 by a gate lock lever 24, the operation device 122 being connected to the pilot hydraulic oil supply path 31*b* on the downstream side of the gate lock valve 100 and including a pilot valve (pressure reducing valve) that generates operation pilot pressure for controlling the flow control valve 6. Further, the operation device 122 is arranged inside the cab 403.

Figure 3:
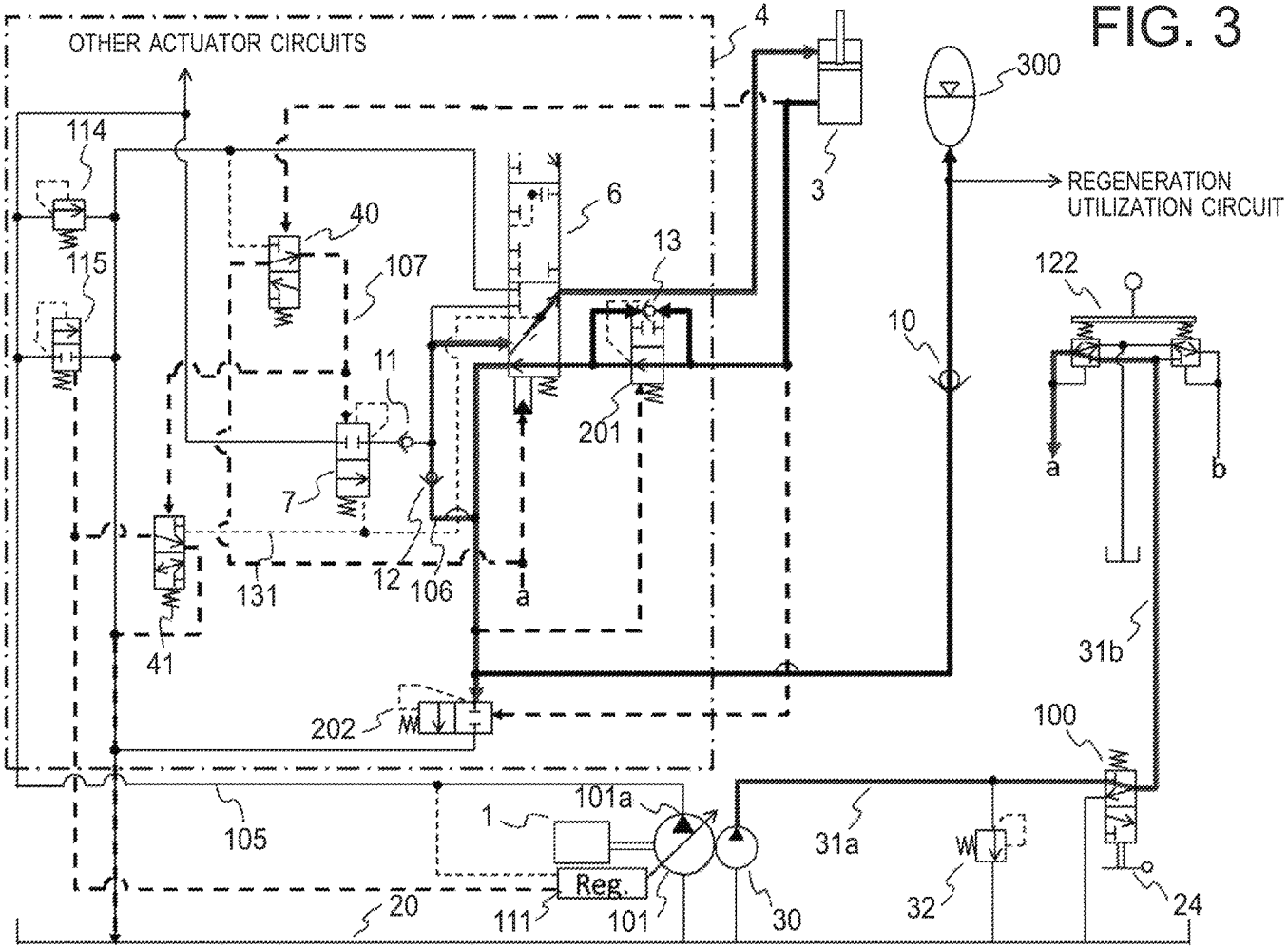
FIG. 3 is an operation diagram of the hydraulic driving device of the work machine shown in FIG. 2.

Next, the motion of the hydraulic driving device will be explained. First, (a) the case a boom lowering motion is executed in the air in a state pressure can be accumulated in the accumulator 300 will be explained using an operation diagram of the hydraulic driving device shown in FIG. 3. In FIG. 3, the lines through which the hydraulic oil flows are shown by bold lines.

As shown in FIG. 3, when the boom lowering motion is to be executed, the boom lowering command pressure a is generated by operating the operation device 122. When the boom lowering motion is executed in the air, since the boom bottom pressure is higher than the threshold value at which the changeover switch 40 is switched, the changeover switch 40 is switched so as to introduce the boom lowering command pressure a to the signal oil path 107. By application of the boom lowering command pressure a to the pressure compensation valve 7, the hydraulic oil of the hydraulic oil supply path 105 is prevented from flowing to the boom cylinder 3.

Moreover, the changeover valve 41 is switched by the pressure of the signal oil path 107, and the tank pressure (approximately 0 MPa) is introduced to the unload valve 115 and the regulator 111 as a load pressure. Thus, the discharge pressure Pp of the main pump 101 is kept at a pressure (unload valve set pressure) that is obtained by adding a set pressure Pun0 of the spring of the unload valve 115 to the tank pressure.

Pun0 is normally set to be slightly higher than the target differential pressure Pref (Pun0>Pref). Here, since the difference P1*s* of the discharge pressure Pp of the main pump 101 and the load pressure becomes P1*s*=Pp−0=Pun0>Pref, the regulator 111 executes control so as to reduce tilting of the main pump 101, and the capacity of the main pump 101 is kept at the minimum.

By the boom lowering command pressure a, the flow control valve 6 strokes, and the boom cylinder 3 is driven to the direction the cylinder contracts. Thus, a part of the cylinder bottom discharged oil flows in to the cylinder rod side of the boom cylinder 3 through the first pressure compensation valve 201, the meter-out throttle of the flow control valve 6, the regeneration oil path 106, the check valve 12, and the meter-in throttle of the flow control valve 6. The remainder of the cylinder bottom discharged oil is introduced to the accumulator 300 and the second pressure compensation valve 202.

Since the accumulator 300 is in a state of capable of accumulating pressure, the first pressure compensation valve 201 operates so that difference between front and back pressures of the meter-out throttle of the flow control valve 6 becomes the target differential pressure Pref, and the cylinder speed is kept at a target speed matching the opening area of the meter-out throttle. At this time, the opening of the first pressure compensation valve 201 is throttled so as to control difference between front and back pressures of the meter-out throttle of the flow control valve 6, and difference between front and back pressures ΔP is generated in the first pressure compensation valve 201. In contrast, the second pressure compensation valve 202 is configured so that a differential pressure Pd of the upstream pressure P1 of the first pressure compensation valve 201 and a downstream pressure P2 of the flow control valve 6 becomes the target differential pressure Pref.

Here, the difference between front and back pressures of the flow control valve 6 is kept at the target differential pressure Pref by the first pressure compensation valve 201, and ΔP is generated as the difference between front and back pressures of the first pressure compensation valve 201.

Accordingly, the differential pressure Pd of the upstream pressure P1 of the first pressure compensation valve 201 and the downstream pressure P2 of the flow control valve 6 becomes Pd=P1-P2=Pref+ΔP>Pref, and therefore the second pressure compensation valve 202 operates to be totally closed. Thus, the cylinder bottom discharged oil of the boom cylinder 3 is accumulated in the accumulator 300 without flowing to the tank 20 (first control state).

As described above, when the boom lowering motion is executed in the air in a state the accumulator 300 is capable of accumulating pressure, energy can be stored in the accumulator 300 while securing the operability of the boom lowering motion.

Figure 4:
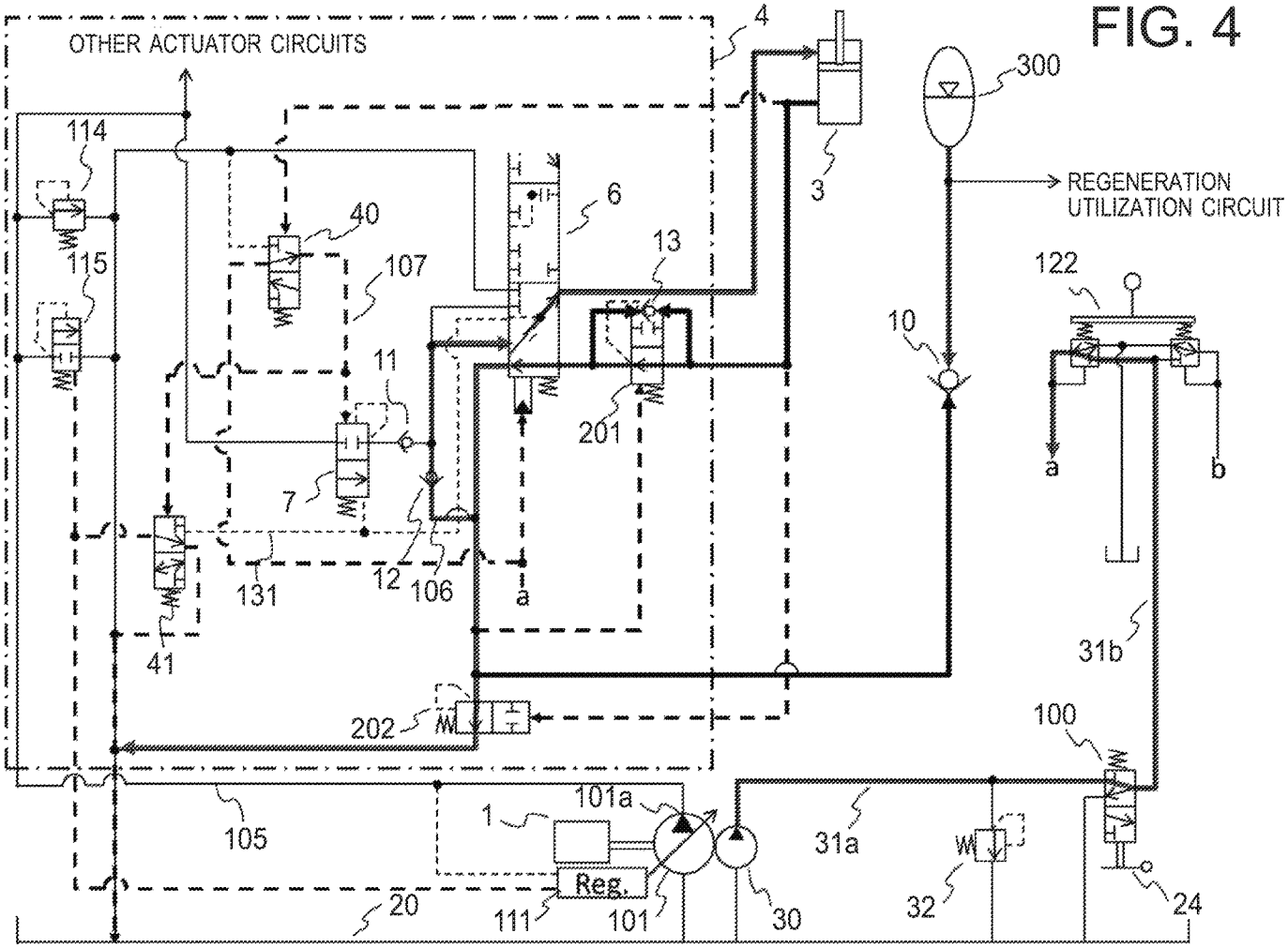
FIG. 4 is an operation diagram of the hydraulic driving device of the work machine shown in FIG. 2.

Next, (b) the case a boom lowering motion is executed in the air in a state pressure has been sufficiently accumulated in the accumulator 300 will be explained using an operation diagram of the hydraulic driving device shown in FIG. 4. In FIG. 4, the lines through which the hydraulic oil flows are shown by bold lines. Also, explanation of a motion same as that of the case of (a) described above will be omitted.

The first pressure compensation valve 201 operates so that the difference between front and back pressures of the meter-out throttle of the flow control valve 6 becomes the target differential pressure Pref. However, since the pressure has been sufficiently accumulated in the accumulator 300, the cylinder bottom discharged oil of the boom cylinder 3 is not made to flow in to the accumulator 300, and the difference between front and back pressures of the meter-out throttle of the flow control valve 6 becomes lower than the target differential pressure Pref even when the first pressure compensation valve 201 opens at the maximum (fully opens). In contrast, the second pressure compensation valve 202 is configured so that the differential pressure Pd of the upstream pressure P1 of the first pressure compensation valve 201 and the downstream pressure P2 of the flow control valve 6 becomes the target differential pressure Pref.

Here, the difference between front and back pressures of the flow control valve 6 is lower than the target differential pressure Pref, the first pressure compensation valve 201 opens at the maximum, this opening is sufficiently large, the differential pressure is not generated, and therefore the difference between front and back pressures ΔP of the first pressure compensation valve 201 becomes approximately 0. Accordingly, the differential pressure Pd of the upstream pressure P1 of the first pressure compensation valve 201 and the downstream pressure P2 of the flow control valve 6 becomes Pd=P1-P2=(less than Pref)+ΔP<Pref, and therefore the second pressure compensation valve 202 opens, and operates so that the differential pressure Pd of the upstream pressure P1 of the first pressure compensation valve 201 and the downstream pressure P2 of the flow control valve 6 becomes the target differential pressure Pref (second control state). As a result, the cylinder bottom discharged oil flows to the tank 20 through the second pressure compensation valve 202.

At this time, since the first pressure compensation valve 201 opens at the maximum and the differential pressure ΔP is approximately 0, the difference between front and back pressures of the meter-out throttle of the flow control valve 6 comes to be controlled to the target differential pressure Pref by the second pressure compensation valve 202, and the cylinder speed of the boom cylinder 3 is kept at a target speed that is proportional to the opening area of the meter-out throttle.

As described above, even when the boom lowering motion is executed in the air in a state pressure has been sufficiently accumulated in the accumulator 300, the cylinder bottom discharged oil from the boom cylinder 3 can be made to flow to the tank 20 through the second pressure compensation valve 202, and therefore the operability of the boom lowering motion can be secured.

Figure 5:
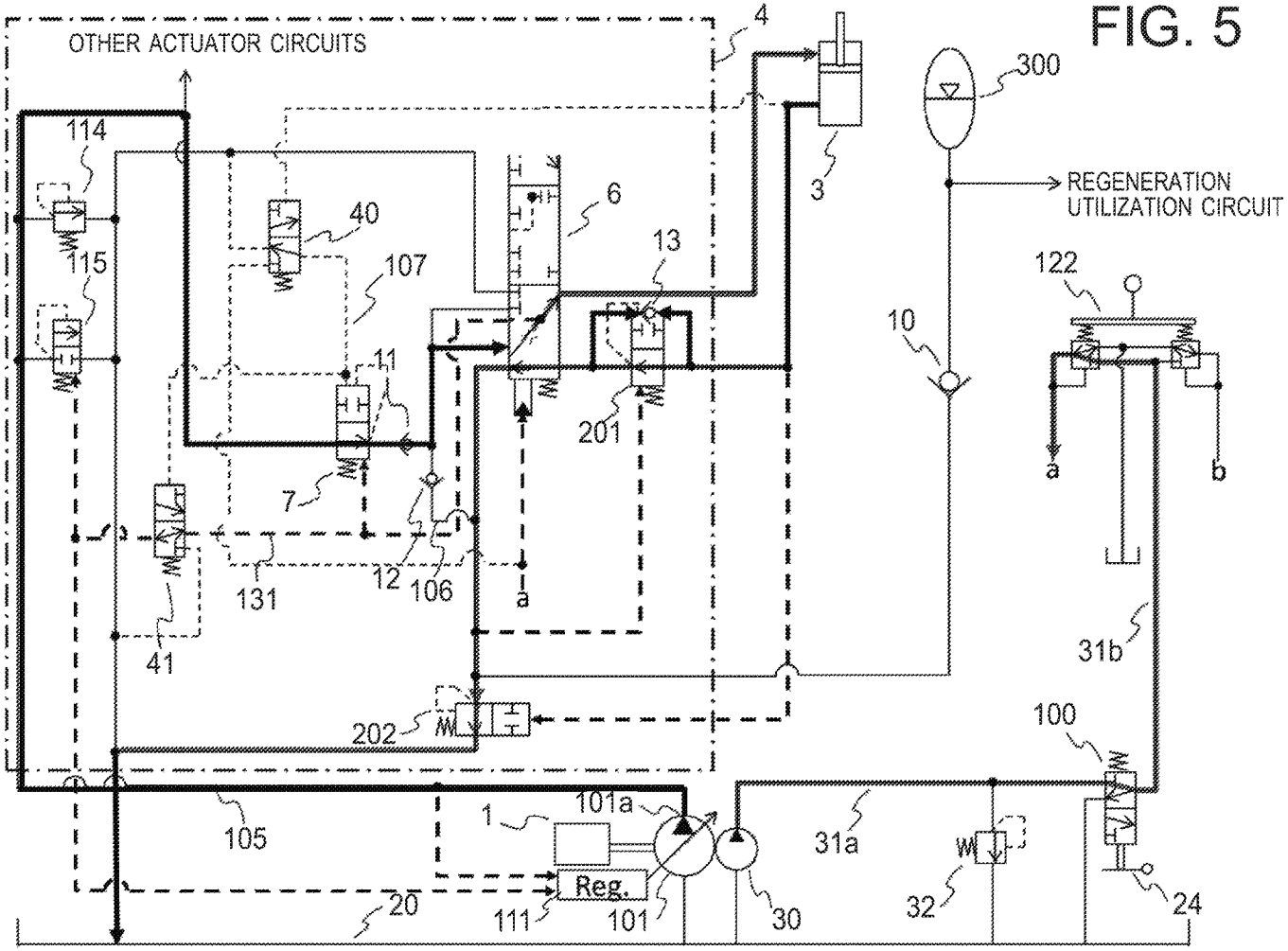
FIG. 5 is an operation diagram of the hydraulic driving device of the work machine shown in FIG. 2.

Next, (c) the case a load is generated at the time of the boom lowering motion (machine body lifting motion) will be explained using an operation diagram of the hydraulic driving device shown in FIG. 5. In FIG. 5, the lines through which the hydraulic oil flows are shown by bold lines.

As shown in FIG. 5, when the boom lowering motion is to be executed, by operating the operation device 122, the boom lowering command pressure a is generated. When a load is generated at the time of the boom lowering motion, the boom bottom pressure becomes lower than the threshold value at which the changeover switch 40 is switched, and therefore the hydraulic oil of the signal oil path 107 is introduced to the tank 20. Since the pressure of the signal oil path 107 becomes the tank pressure (approximately 0 MPa), the pressure compensation valve 7 executes pressure compensation control so that the difference between front and back pressures of the meter-in throttle of the flow control valve 6 becomes constant, and the changeover switch 41 introduces the pressure of the load detection circuit 131 to the unload valve 115 and the regulator 111.

By the boom lowering command pressure a, the flow control valve 6 strokes, and the boom cylinder 3 is driven to the direction the cylinder contracts. At this time, the load detection circuit 131 detects P1 as a load pressure, and P1 is introduced to the unload valve 115 and the regulator 111. Thus, the discharge pressure Pp of the main pump 101 increases by the regulator 111 so as to become a pressure that is obtained by adding Pref to P1, and the unload valve set pressure of the unload valve 115 increases to a pressure that is obtained by adding the set pressure Pun0 of the spring of the unload valve 115 to P1, and shuts off the oil path that discharges the hydraulic oil of the hydraulic oil supply path 105 to the tank 20.

When a heavy load is generated on the cylinder rod side at the time of the boom lowering motion, the cylinder bottom pressure of the boom cylinder 3 is lower than the pressure P1 of the load detection circuit 131, the upstream pressure of the meter-in throttle of the flow control valve 6 is higher than the pressure P1, therefore the cylinder bottom discharged oil of the boom cylinder 3 cannot pass through the check valve 12, and all flow is introduced to the second pressure compensation valve 202 and the accumulator 300.

The cylinder speed is determined by a flow rate of flowing in to the cylinder rod side, namely the passing through flow rate of the meter-in throttle of the flow control valve 6, the passing through flow rate of the meter-in throttle of the flow control valve 6 is determined by an opening area Ai of the meter-in throttle by load sensing control, whereas the cylinder bottom discharge flow rate is determined by an area ratio n of the bottom side pressure receiving area and the rod side pressure receiving area of the cylinder.

Here, by making an opening area Ao of the meter-out throttle of the flow control valve 6 Ao>n×Ai, while the load sensing control is executed, the difference between front and back pressures of the meter-out throttle becomes lower than the target differential pressure Pref constantly. Thus, the opening of the first pressure compensation valve 201 and the second pressure compensation valve 202 becomes the maximum, and the cylinder bottom discharged oil comes to be discharged to the tank 20.

As described above, even when a load is generated at the time of the boom lowering motion such as the machine body lifting motion, the second pressure compensation valve 202 operates so as to discharge the cylinder bottom discharged oil of the boom cylinder 3 to the tank 20, and therefore a desired motion can be executed.

Second Embodiment

Figure 6:
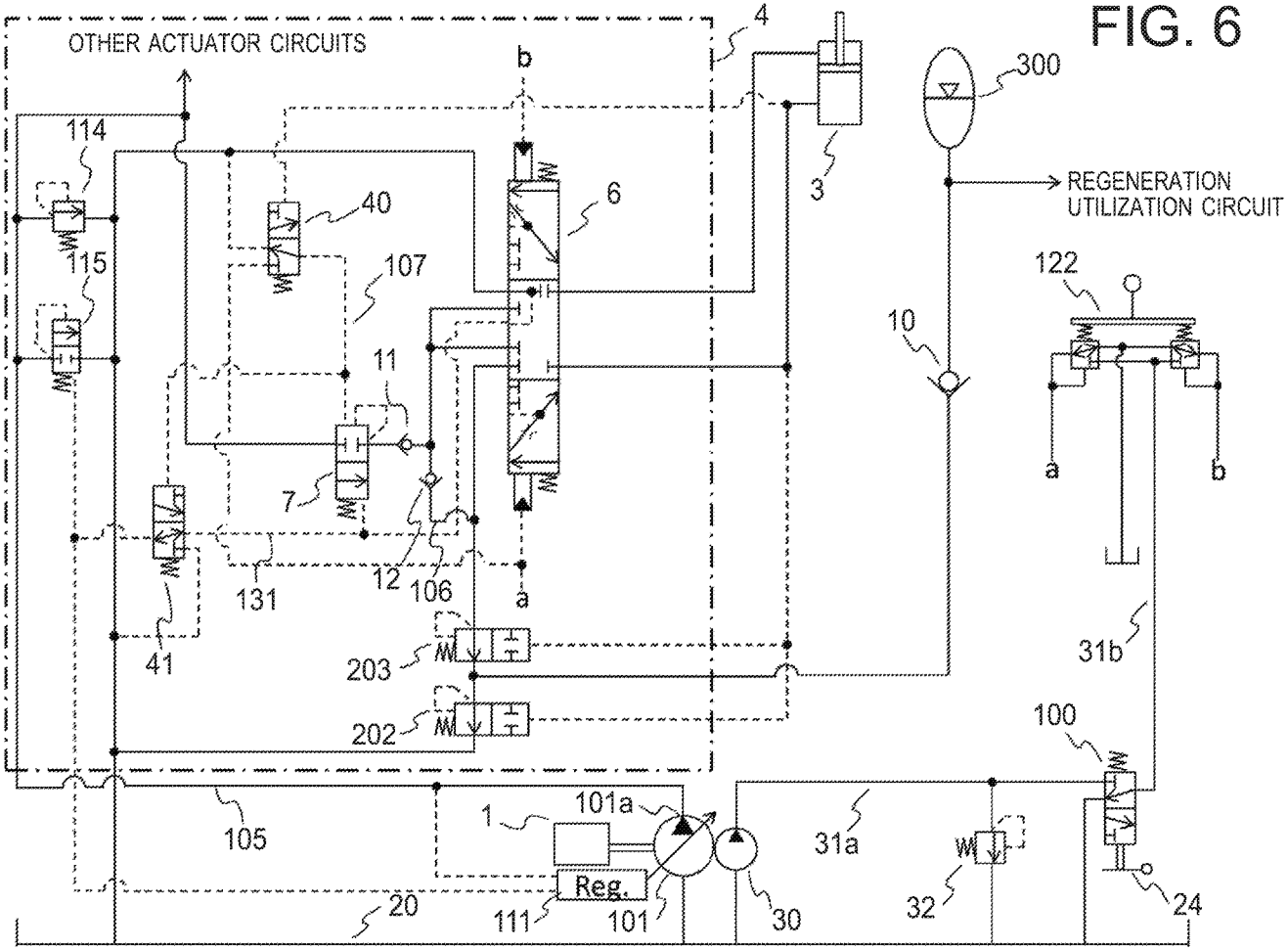
FIG. 6 is a block diagram of a hydraulic driving device of a work machine related to a second embodiment of the present invention.

Next, the hydraulic driving device related to a second embodiment of the present invention will be explained. FIG. 6 is a block diagram of the hydraulic driving device related to the second embodiment. As shown in FIG. 6, the hydraulic driving device related to the second embodiment does not include the first pressure compensation valve 201 of the first embodiment. Alternatively, in the second embodiment, a first pressure compensation valve 203 is included on the upstream side of the second pressure compensation valve 202 and between the flow control valve 6 and the accumulator 300, the first pressure compensation valve 203 controlling the flow control valve 6 so that the difference between front and back pressures of the flow control valve 6 becomes the target differential pressure Pref. Moreover, the second embodiment differs from the first embodiment in terms that it is configured in the second embodiment that it is controlled by the second pressure compensation valve 202 so that the upstream pressure of the flow control valve 6 and the downstream pressure of the first pressure compensation valve 203 become the target differential pressure Pref.

Figure 7:
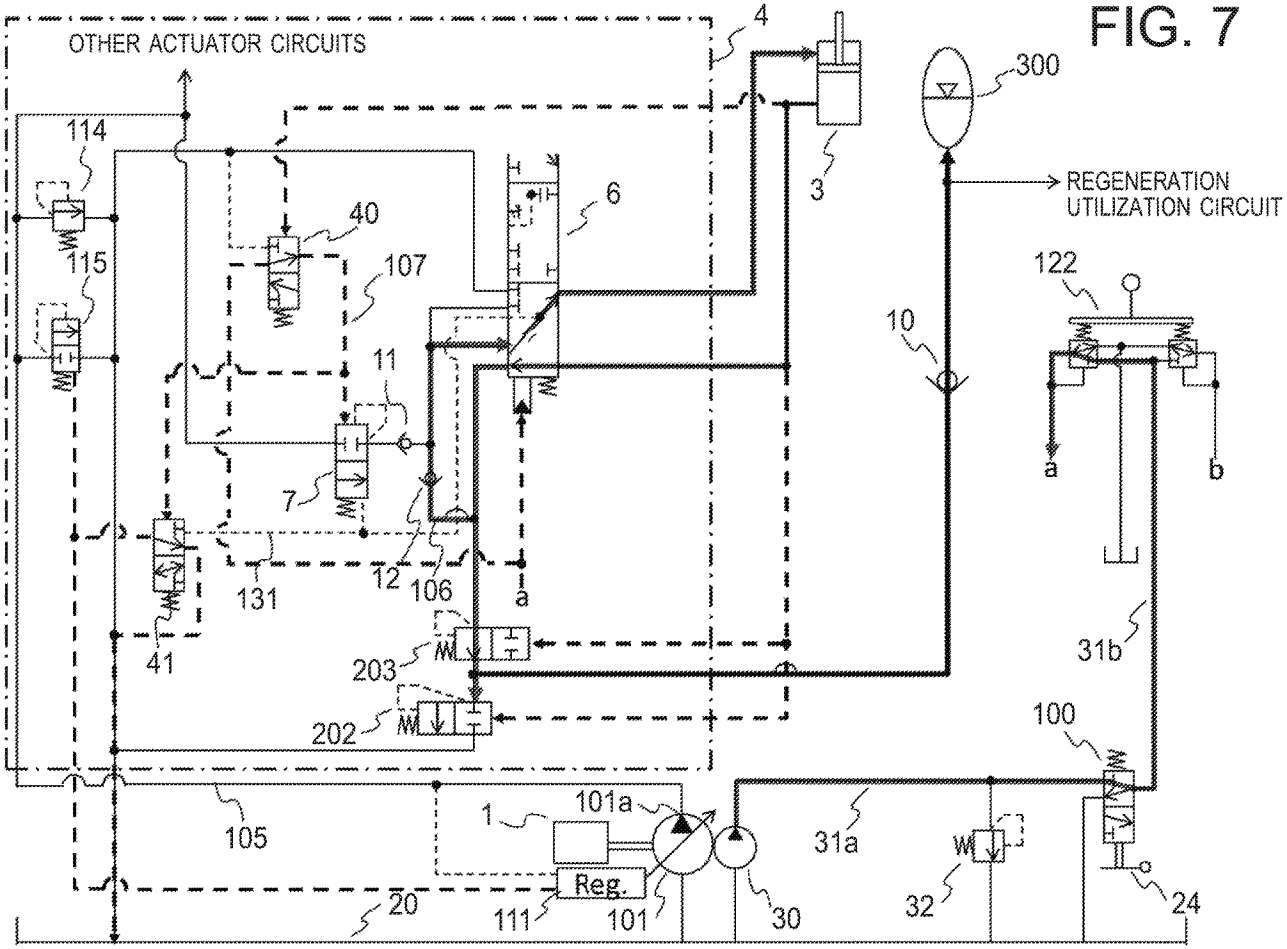
FIG. 7 is an operation diagram of the hydraulic driving device of the work machine shown in FIG. 6.

Next, the motion of the hydraulic driving device will be explained. First, (a) the case a boom lowering motion is executed in the air in a state pressure can be accumulated in the accumulator 300 will be explained using an operation diagram of the hydraulic driving device shown in FIG. 7. In FIG. 7, the lines through which the hydraulic oil flows are shown by bold lines. In addition, explanation duplicating with the first embodiment will be omitted.

Since the accumulator 300 is in a state of capable of accumulating pressure, the first pressure compensation valve 203 operates so that the difference between front and back pressures of the meter-out throttle of the flow control valve 6 becomes the target differential pressure Pref, and the cylinder speed is kept to a target speed matching the opening area of the meter-out throttle. At this time, in order that the first pressure compensation valve 203 controls the difference between front and back pressures of the meter-out throttle of the flow control valve 6, the opening of the first pressure compensation valve 203 is throttled, and the difference between front and back pressures ΔP is generated in the first pressure compensation valve 203. In contrast, the second pressure compensation valve 202 is configured so that the differential pressure Pd of an upstream pressure P3 of the flow control valve 6 and a downstream pressure P4 of the first pressure compensation valve 203 becomes the target differential pressure Pref.

Here, the difference between front and back pressures of the flow control valve 6 is kept at the target differential pressure Pref by the first pressure compensation valve 203, and ΔP is generated as the difference between front and back pressures of the first pressure compensation valve 203. Accordingly, the differential pressure Pd of the upstream pressure P3 of the flow control valve 6 and the downstream pressure P4 of the first pressure compensation valve 203 becomes Pd=P3-P4=Pref+ΔP>Pref, and therefore the second pressure compensation valve 202 operates to be fully closed. Thus, the cylinder bottom discharged oil of the boom cylinder 3 is accumulated in the accumulator 300 without flowing to the tank 20 (first control state).

Figure 8:
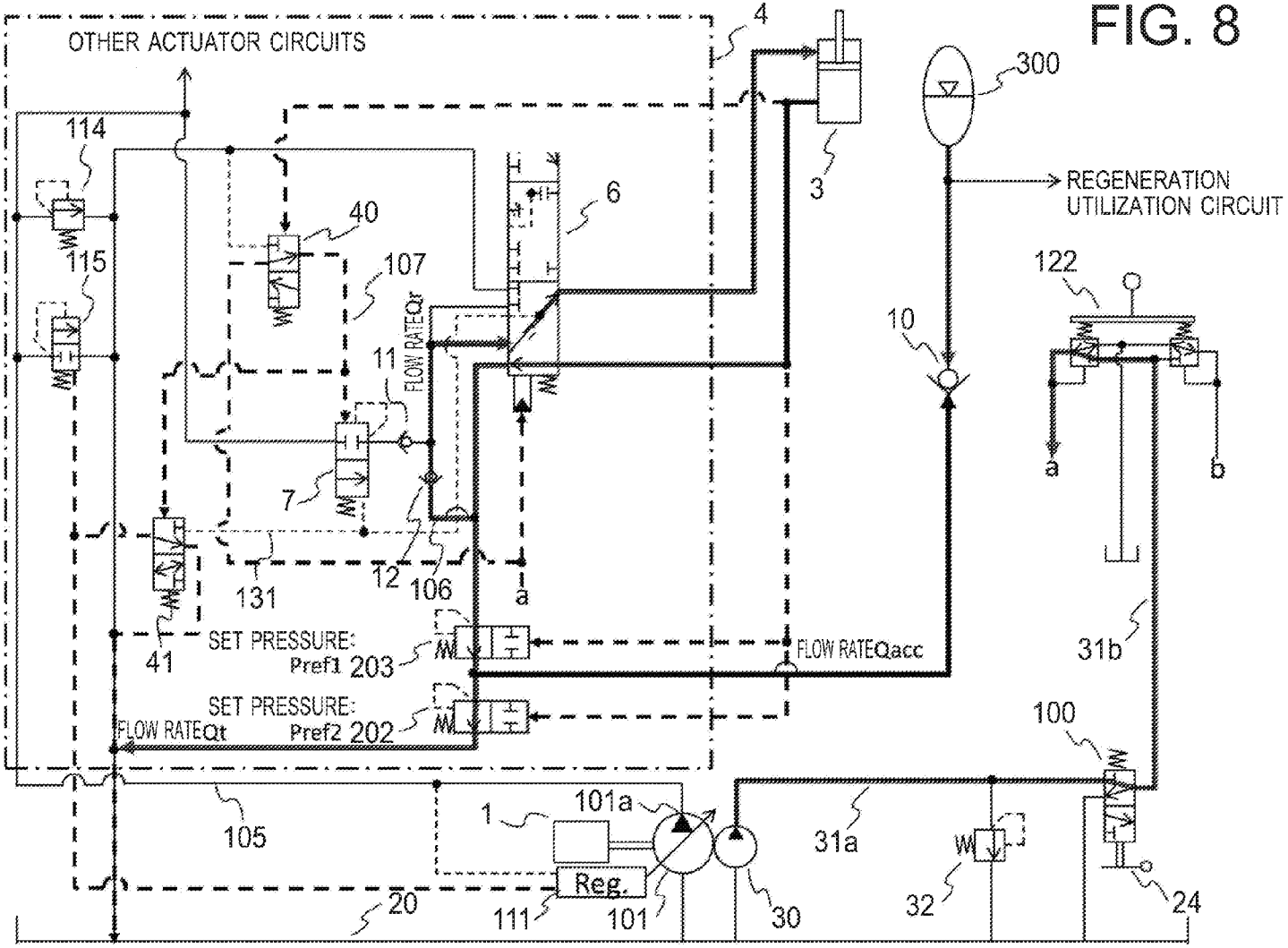
FIG. 8 is an operation diagram of the hydraulic driving device of the work machine shown in FIG. 6.

Next, (b) the case a boom lowering motion is executed in the air in a state pressure has been sufficiently accumulated in the accumulator 300 will be explained using an operation diagram of the hydraulic driving device shown in FIG. 8. In FIG. 8, the lines through which the hydraulic oil flows are shown by bold lines.

The first pressure compensation valve 203 operates so that the difference between front and back pressures of the meter-out throttle of the flow control valve 6 becomes the target differential pressure Pref. However, since the pressure has been sufficiently accumulated in the accumulator 300, the cylinder bottom discharged oil of the boom cylinder 3 is not made to flow in to the accumulator 300, and the difference between front and back pressures of the meter-out throttle of the flow control valve 6 becomes lower than the target differential pressure Pref even when the first pressure compensation valve 203 opens at the maximum (fully opens). In contrast, the second pressure compensation valve 202 is configured so that the differential pressure Pd of the upstream pressure P3 of the flow control valve 6 and the downstream pressure P4 of the first pressure compensation valve 203 becomes the target differential pressure Pref.

Here, the difference between front and back pressures of the flow control valve 6 is lower than the target differential pressure Pref, the first pressure compensation valve 203 is opened at the maximum, this opening is sufficiently large, the differential pressure is not generated, and therefore the difference between front and back pressures ΔP of the first pressure compensation valve 203 becomes approximately 0. Accordingly, the differential pressure Pd of the upstream pressure P3 of the flow control valve 6 and the downstream pressure P4 of the first pressure compensation valve 203 becomes Pd=P3-P4=(less than Pref)+ΔP<Pref, and therefore the second pressure compensation valve 202 opens, and operates so that the differential pressure Pd of the upstream pressure P3 of the flow control valve 6 and the downstream pressure P4 of the first pressure compensation valve 203 becomes the target differential pressure Pref. As a result, the cylinder bottom discharged oil flows to the tank 20 through the second pressure compensation valve 202 (second control state).

At this time, since the first pressure compensation valve 203 opens at the maximum and the differential pressure ΔP is approximately 0, the difference between front and back pressures of the meter-out throttle of the flow control valve 6 comes to be controlled to the target differential pressure Pref by the second pressure compensation valve 202, and the cylinder speed of the boom cylinder 3 is kept at a target speed that is proportional to the opening area of the meter-out throttle.

Figure 9:
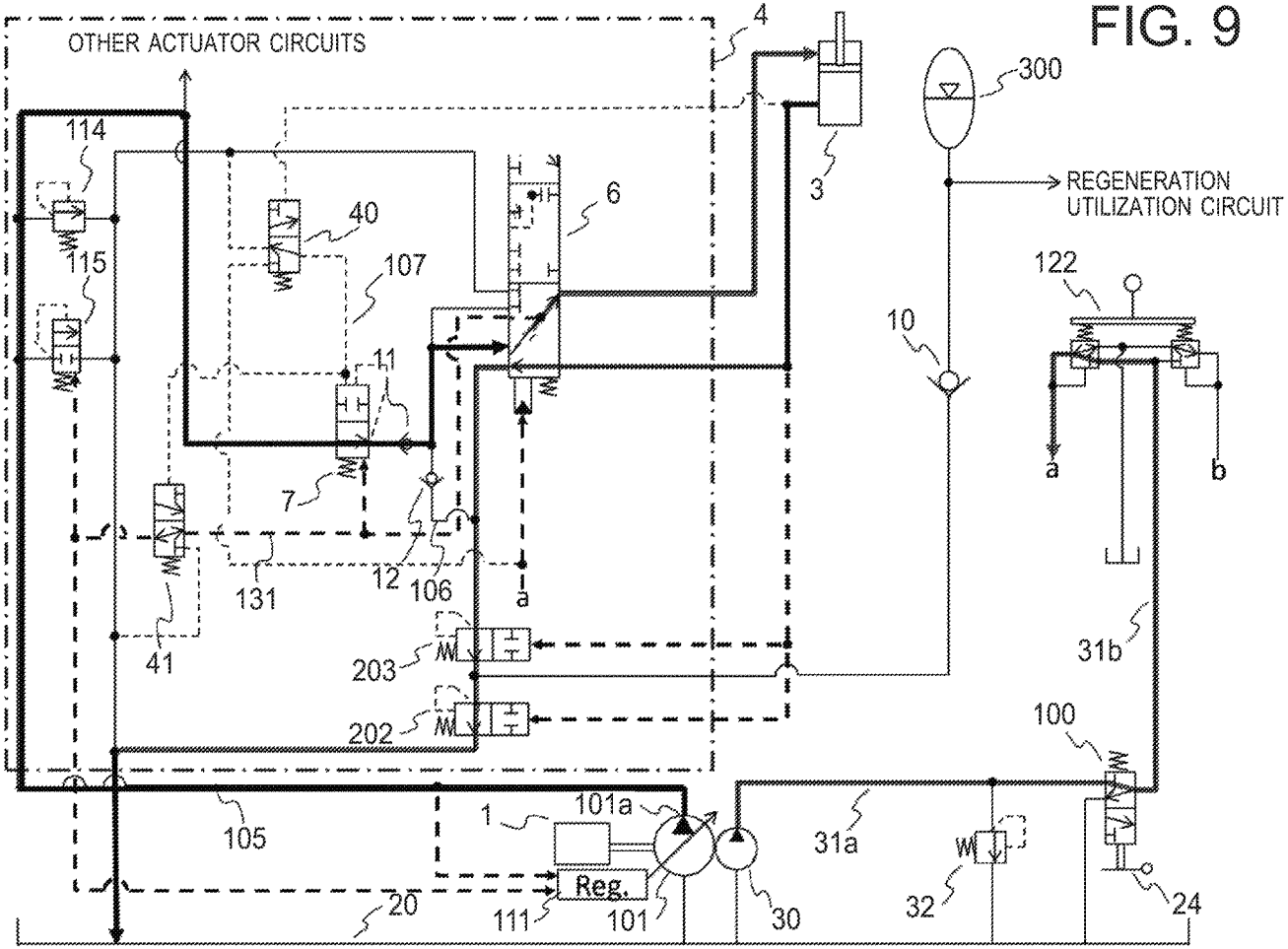
FIG. 9 is an operation diagram of the hydraulic driving device of the work machine shown in FIG. 6.

Next, (c) the case a load is generated at the time of the boom lowering motion (machine body lifting motion) will be explained using an operation diagram of the hydraulic driving device shown in FIG. 9. In FIG. 9, the lines through which the hydraulic oil flows are shown by bold lines. In this case, similarly to the first embodiment, since the second pressure compensation valve 202 and the first pressure compensation valve 203 open, even when the machine body lifting motion is executed at the time of the boom lowering motion, the cylinder bottom discharged oil of the boom cylinder 3 can be discharged to the tank 20, and a desired motion can be executed.

Here, in the second embodiment and the first embodiment, when the set pressure of the first pressure compensation valve 203 is made to be Pref1 and the set pressure of the second pressure compensation valve 202 is made to be Pref2, the set pressure Pref1 and the set pressure Pref2 may be set to be equal to each other, and may be set so that either one becomes larger than the other. Below, for each of (1) a case of set pressure Pref1=set pressure Pref2, (2) a case of set pressure Pref1>set pressure Pref2, and (3) a case of set pressure Pref1<set pressure Pref2, the relation between a flow rate Qacc of a flow to the accumulator 300 and a flow rate Qt of a flow to the tank 20 will be explained.

Figure 10:
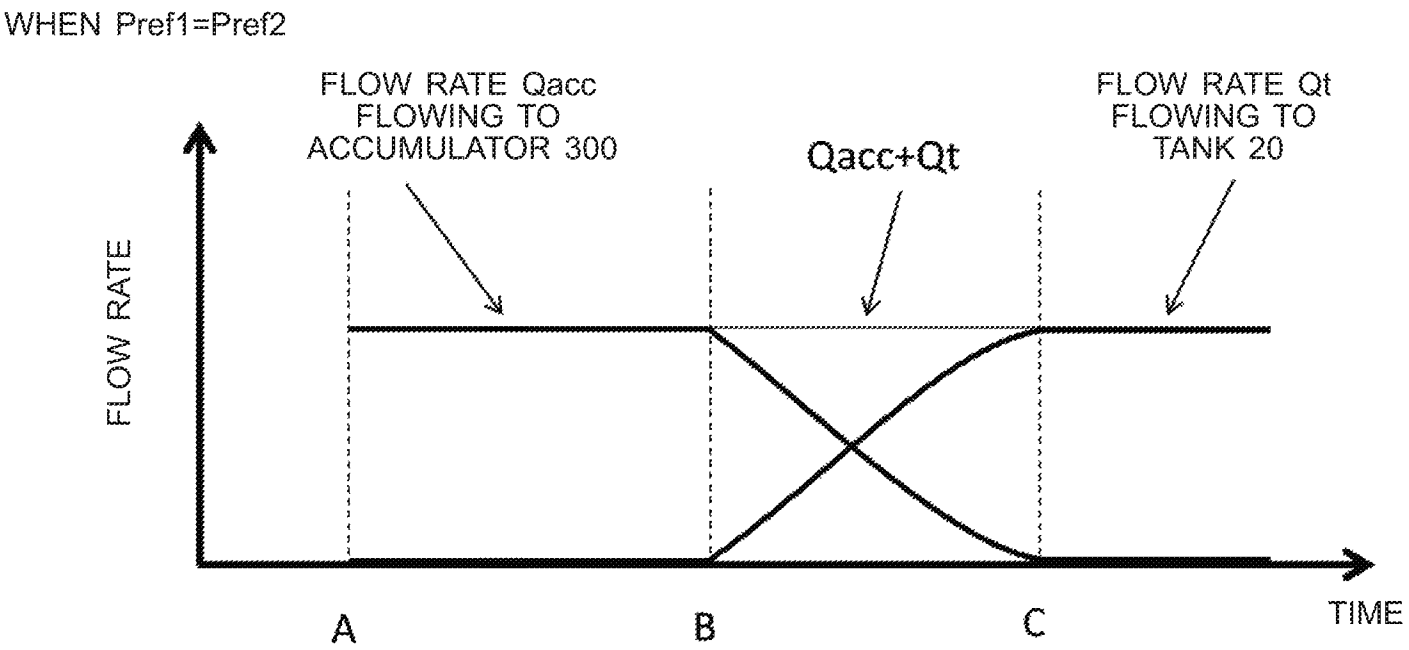
FIG. 10 is a drawing showing the relation between a flow rate Qacc and a flow rate Qt, a cylinder bottom discharged oil of a boom cylinder flowing to an accumulator with the flow rate Qacc and flowing to a tank with the flow rate Qt when a set pressure Pref1 and a set pressure Pref2 are equal.

(1) The Case of Set Pressure Pref1=Set Pressure Pref2:

FIG. 10 shows the relation between the flow rate Qacc and the flow rate Qt when the set pressure Pref1 and the set pressure Pref2 are equal to each other, the cylinder bottom discharged oil of the boom cylinder 3 flowing to the accumulator 300 with the flow rate Qacc and flowing to the tank 20 with the flow rate Qt. In addition, in FIG. 10, the vertical axis represents the flow rate, and the horizontal axis represents the time.

At a time point A, the boom lowering motion starts. In a section of A to B, the flow rate is controlled only by the first pressure compensation valve 203, and the second pressure compensation valve 202 is closed. Therefore, in the section of A to B, the cylinder bottom discharged oil of a constant flow rate Qacc flows to the accumulator 300 by control of the first pressure compensation valve 203.

At a time point B, the first pressure compensation valve 203 comes to fully open, and the second pressure compensation valve 202 starts to open. Therefore, the flow rate Qacc of the cylinder bottom discharged oil that flows to the accumulator 300 gradually reduces, and the flow rate Qt of the cylinder bottom discharged oil that flows to the tank 20 gradually increases. At this time, since the set pressure Pref1 and the set pressure Pref2 are the same set pressure, in a section of B to C, the flow rate is controlled so as to satisfy flow rate Qacc+flow rate Qt=constant.

When pressure accumulation to the accumulator 300 is completed at a time point C, the flow rate Qacc of a flow that flows to the accumulator 300 becomes 0. At the time point C and thereafter, the cylinder bottom discharged oil of a constant flow rate Qt flows to the tank 20 by control of the second pressure compensation valve 202. In addition, the flow rate of a flow that passes through the flow control valve 6 (stroke speed) becomes a flow rate (Qr+Qacc+Qt) that is obtained by adding a regeneration flow rate Qr to the flow rate of the cylinder bottom discharged oil (Qacc+Qt) (refer to FIG. 8).

By setting the set pressure Pref1 of the first pressure compensation valve 203 and the set pressure Pref2 of the second pressure compensation valve 202 so as to be equal to each other as described above, the flow rate of the cylinder bottom discharged oil at the time of the boom lowering motion can be kept constant, therefore the behavior of the boom lowering motion can be stabilized, and the operability improves.

Figure 11:
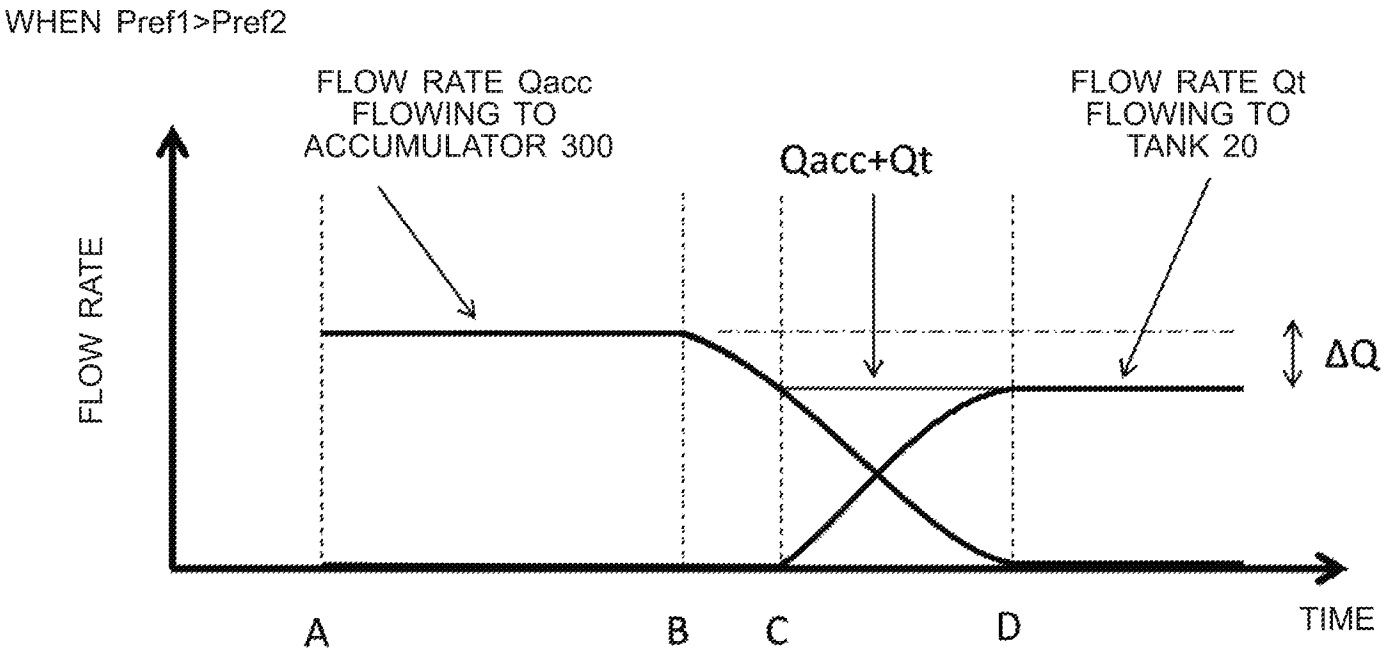
FIG. 11 is a drawing showing the relation between the flow rate Qacc and the flow rate Qt, the cylinder bottom discharged oil of the boom cylinder flowing to the accumulator with the flow rate Qacc and flowing to the tank with the flow rate Qt when the set pressure Pref1 is higher than the set pressure Pref2.

(2) The Case of Set Pressure Pref1>Set Pressure Pref2:

FIG. 11 shows the relation between the flow rate Qacc and the flow rate Qt when the set pressure Pref1 is higher than the set pressure Pref2, the cylinder bottom discharged oil of the boom cylinder 3 flowing to the accumulator 300 with the flow rate Qacc and flowing to the tank 20 with the flow rate Qt. In addition, in FIG. 11, the vertical axis represents the flow rate, and the horizontal axis represents the time.

At the time point A, the boom lowering motion starts. In the section of A to B, the flow rate is controlled only by the first pressure compensation valve 203, and the second pressure compensation valve 202 is closed. Therefore, in the section of A to B, the cylinder bottom discharged oil of the constant flow rate Qacc flows to the accumulator 300 by control of the first pressure compensation valve 203.

At the time point B, the first pressure compensation valve 203 comes to fully open. However, at the time point B, the set pressure of the first pressure compensation valve 203 is Pref1, whereas the set pressure of the second pressure compensation valve 202 is Pref2 (<Pref1), and therefore the second pressure compensation valve 202 does not operate (does not open). According to increase of the pressure of the accumulator 300, the differential pressure of the upstream pressure of the flow control valve 6 and the downstream pressure of the first pressure compensation valve 203 reduces (the flow rate also reduces), the differential pressure of the upstream pressure of the flow control valve 6 and the downstream pressure of the first pressure compensation valve 203 becomes Pref2 at the time point C, and therefore the second pressure compensation valve 202 starts to open. Accordingly, in the section of B to C, the cylinder bottom discharged oil flows to the accumulator 300, but does not flow to the tank 20.

In a section of C to D, the cylinder bottom discharged oil flows to the accumulator 300 and the tank 20. At this time, the first pressure compensation valve 203 is fully opened, the flow rate is controlled only by the second pressure compensation valve 202, and therefore the total of the flow rate Qacc of a flow that flows to the accumulator 300 and the flow rate Qt of a flow that flows to the tank 20 becomes a value determined by the set pressure Pref2 of the second pressure compensation valve 202. Moreover, at a time point of D and thereafter, D being the time point when pressure accumulation of the accumulator 300 is completed, all of the cylinder bottom discharged oil flows to the tank 20 by control of the second pressure compensation valve 202.

By setting the set pressure Pref1 of the first pressure compensation valve 203 so as to be higher than the set pressure Pref2 of the second pressure compensation valve 202 as described above, with respect to the section of B to C, the cylinder bottom discharged oil can be made to flow only to the accumulator 300, and therefore pressure can be accumulated preferentially in the accumulator 300.

Figure 12:
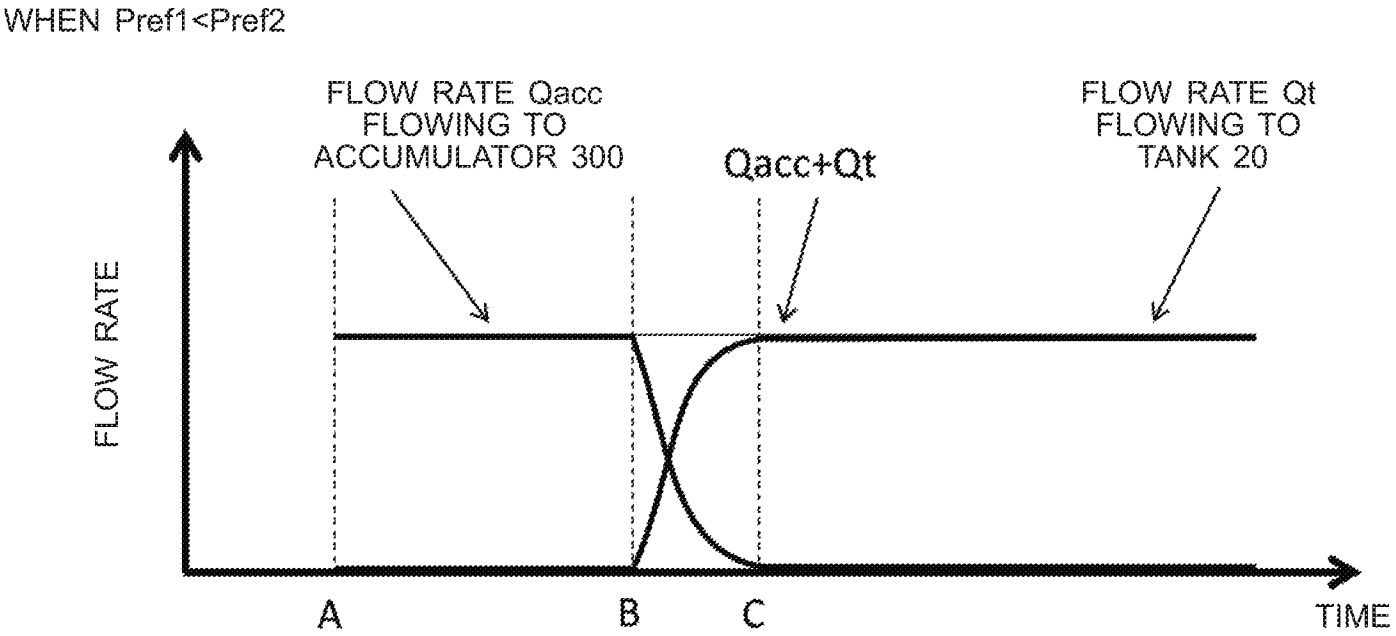
FIG. 12 is a drawing showing the relation between the flow rate Qacc and the flow rate Qt, the cylinder bottom discharged oil of the boom cylinder flowing to the accumulator with the flow rate Qacc and flowing to the tank with the flow rate Qt when the set pressure Pref1 is lower than the set pressure Pref2.

(3) The Case of Set Pressure Pref1<Set Pressure Pref2:

FIG. 12 shows the relation between the flow rate Qacc and the flow rate Qt when the set pressure Pref1 is lower than the set pressure Pref2, the cylinder bottom discharged oil of the boom cylinder 3 flowing to the accumulator 300 with the flow rate Qacc and flowing to the tank 20 with the flow rate Qt. In addition, in FIG. 12, the vertical axis represents the flow rate, and the horizontal axis represents the time.

At the time point A, the boom lowering motion starts. In the section of A to B, the flow rate is controlled only by the first pressure compensation valve 203, and the second pressure compensation valve 202 is closed. Therefore, in the section of A to B, the cylinder bottom discharged oil of the constant flow rate Qacc flows to the accumulator 300 by control of the first pressure compensation valve 203.

At the time point B, the difference between front and back pressures of the first pressure compensation valve 203 becomes Pref2−Pref1, the total of the difference between front and back pressures of the flow control valve 6 (=Pref1) and the difference between front and back pressures of the first pressure compensation valve 203 (=Pref2−Pref1) becomes Pref2, and therefore the second pressure compensation valve 202 starts to open. Accordingly, in the section of B to C, the flow rate is controlled by both of the first pressure compensation valve 203 and the second pressure compensation valve 202, and the cylinder bottom discharged oil flows to both of the accumulator 300 and the tank 20.

At the time point C and thereafter, all flow of the cylinder bottom discharged oil flows to the tank 20. At this time also, the flow rate is controlled by both of the first pressure compensation valve 203 and the second pressure compensation valve 202, and the cylinder bottom discharged oil flows in a state the total of the difference between front and back pressures of the flow control valve 6 (=Pref1) and the difference between front and back pressures of the first pressure compensation valve 203 (=Pref2−Pref1) is Pref2. Accordingly, at the time point B and thereafter, although both of the first pressure compensation valve 203 and the second pressure compensation valve 202 operate, the differential pressure of the flow control valve 6 is kept at Pref1 by the first pressure compensation valve 203, and therefore the passing through flow rate of the flow control valve 6 becomes constant.

By setting the set pressure Pref1 of the first pressure compensation valve 203 so as to be lower than the set pressure Pref2 of the second pressure compensation valve 202 as described above, the flow rate of the cylinder bottom discharged oil at the time of the boom lowering motion can be kept constant, therefore the behavior of the boom lowering motion can be stabilized, and the operability improves.

From the above, in the second embodiment, when it is desired to prevent fluctuation in the flow rate so as not to affect the operability, Pref2 only has to be made to be equal to or higher than Pref1 (in the case of (1) or (3)). At this time, in order that pressure can be accumulated more in the accumulator 300, Pref2 is preferable to be close to Pref1, and Pref1=Pref2 is more preferable (in the case of (1)). However, if a flow rate fluctuation ΔQ is permissible from the viewpoint of the operability, Pref2 may be made to be lower than Pref1 in the range where the flow rate fluctuation ΔQ is permissible from the viewpoint of the operability putting emphasis on the pressure accumulation amount to the accumulator 300 (in the case of (2)).

Moreover, the relation between the set pressure of Pref1 and Pref2 and the fluctuation of the flow rate described above is also similar with respect to the first embodiment.

As described above, according to respective embodiments, even in a state pressure has been sufficiently accumulated in the accumulator 300, the difference between front and back pressures of the flow control valve 6 can be kept constant, the actuator speed can be kept at a speed that is proportional to the opening area of the meter-out throttle of the flow control valve 6, and the operability of the boom 405 that is driven by the boom cylinder 3 can be kept excellent. Furthermore, since the hydraulic driving device can be configured using common pressure compensation valves 201, 202, and 203, more convenient device having high versatility can be achieved.

In addition, the embodiments described above are exemplifications for explanation of the present invention, and are not intended to limit the scope of the present invention to those embodiments only. A person with an ordinary skill in the art can implement the present invention in other various embodiments without departing from the substance of the present invention. The present invention is not limited to the hydraulic driving device of the boom cylinder 3, and can be applied to an arm cylinder, a bucket cylinder, and other hydraulic actuators, for example. Further, the present invention may be applied to work machines other than a hydraulic excavator such as a wheel loader, for example.

What is claimed is:

1. A hydraulic driving device of a work machine, comprising:

a hydraulic actuator that is operated by hydraulic oil supplied;

a tank that stores return oil from the hydraulic actuator;

a flow control valve for making hydraulic oil discharged from the hydraulic actuator flow toward the tank; and a pressure accumulator that accumulates pressure of the hydraulic oil that flows from the flow control valve toward the tank, wherein there are provided:

a first pressure compensation valve that is arranged between the hydraulic actuator and the pressure accumulator and is for controlling difference between front and back pressures of the flow control valve constant; and a second pressure compensation valve that is arranged between the pressure accumulator and the tank and is for controlling difference between front and back pressures of the flow control valve and the first pressure compensation valve constant.

2. The hydraulic driving device of a work machine according to claim 1, wherein the first pressure compensation valve is arranged on the upstream side of the flow of hydraulic oil discharged from the hydraulic actuator with respect to the flow control valve, and the second pressure compensation valve controls difference between front pressure of the first pressure compensation valve and back pressure of the flow control valve constant.

3. The hydraulic driving device of a work machine according to claim 2, wherein first target differential pressure set for the first pressure compensation valve and second target differential pressure set for the second pressure compensation valve are equal.

4. The hydraulic driving device of a work machine according to claim 1, wherein the first pressure compensation valve is arranged on the downstream side of the flow of hydraulic oil discharged from the hydraulic actuator with respect to the flow control valve, and the second pressure compensation valve controls difference between front pressure of the flow control valve and back pressure of the first pressure compensation valve constant.

5. The hydraulic driving device of a work machine according to claim 4, wherein first target differential pressure set for the first pressure compensation valve is equal to or less than second target differential pressure set for the second pressure compensation valve.

* * * * *